US006247209B1

(12) United States Patent
Pferdehirt

(10) Patent No.: US 6,247,209 B1
(45) Date of Patent: Jun. 19, 2001

(54) CAPPED RIVET

(75) Inventor: Thomas Pferdehirt, Wuppertal (DE)

(73) Assignee: YKK Europe Ltd., London (GB)

( * ) Notice: Subject to any disclaimer, the term of this patent is extended or adjusted under 35 U.S.C. 154(b) by 0 days.

(21) Appl. No.: 09/363,718

(22) Filed: Jul. 29, 1999

(30) Foreign Application Priority Data

Jul. 30, 1998 (DE) ..... 198 34 458

(51) Int. Cl.[7] ..... A44B 1/44
(52) U.S. Cl. ..... 24/113 MP; 24/94; 24/691
(58) Field of Search ..... 24/688–691, 621, 24/94, 95, 113 R, 113 MP, 114.9, 662; 411/501–503

(56) References Cited

U.S. PATENT DOCUMENTS

| | | | |
|---|---|---|---|
| 2,759,237 | | 5/1956 | Scovill . |
| 4,509,232 | * | 4/1985 | Kanzaka . |
| 4,562,624 | * | 1/1986 | Kanzaka . |
| 4,698,881 | * | 10/1987 | Watanabe . |
| 5,745,964 | * | 5/1998 | Luer et al. . |
| 6,047,449 | * | 4/2000 | Pferdehirt . |

FOREIGN PATENT DOCUMENTS

| | | |
|---|---|---|
| 638817 | 11/1936 | (DE) . |
| 195 43 728 A1 | 5/1997 | (DE) . |
| 196 38 450 C1 | 11/1997 | (DE) . |
| 0146133 | 6/1985 | (EP) . |
| 2184188 | 6/1987 | (GB) . |

OTHER PUBLICATIONS

Patent Abstracts of Japan, vol. 1998, No. 09, Jul. 31, 1998 & JP 10 099106 A (Tokai TAC:KK), Apr. 21, 1998.

* cited by examiner

*Primary Examiner*—James R. Brittain
(74) *Attorney, Agent, or Firm*—Friedrich Kueffner

(57) ABSTRACT

A capped rivet has a cap 10 with an exposed topside 14 and an inside 18 and further has a rivet part 20 with a rivet shank 22 and a rivet flange 24. The rivet shank 22 extends away from the inside 18 of the cap 10 and the rivet flange 24 extends transverse to the axis 23 of the rivet shank 22. The rivet flange 24 is firmly attached to the cap 10, and a reinforcing element 26 is arranged at the underside 25 of the rivet flange 24.

9 Claims, 3 Drawing Sheets

CAPPED RIVET

BACKGROUND OF THE INVENTION

1. Field of the Invention

The present invention relates to a capped rivet with two parts: a cap part (cap, for short) and a rivet part. The cap has an exposed topside and an inside, and the rivet part has a rivet shank and a rivet flange. The rivet shank extends away from the inside of the cap, and the rivet flange extends transverse to the axis of the rivet shank and is firmly attached to the cap. The invention also relates to an attachable element comprising a capped rivet of this kind and to a carrier material to which the attachable element is connected.

Capped rivets as introduced above may have the form of decorative elements that are attachable to a sheet-like carrier material, for example to clothing garments and carrying bags. Furthermore, capped rivets of this kind may also be used for attaching snap-button closure elements to a sheet-like carrier material. In this case, the rivet shank is passed through the carrier material and then shaped to form the attachment of the capped rivet. To protect the carrier material or to attach a snap-button closure part, it is possible to first slide a counterpart such as a lug or a ball forming the snap-button closure part onto the rivet shank after it has been passed through the carrier material and then clamp the counterpart against the carrier material by deforming the rivet shank.

The deformation of the rivet shank required for fastening the capped rivet is usually performed by a rivet-installation machine comprising a riveting tool that presses against the exposed topside of the cap and pushes the rivet shank through the carrier material against a tool that holds the counterpart.

2. Description of the Related Art

A known capped rivet used for the installation of snap-button closure parts is shown in FIG. 5. This capped rivet has a cap 100 and a rivet part 110 consisting of a rivet shank 112 and a rivet flange 114. To attach the rivet part to the cap, the outer rim 106 of the cap 100 is bent downward and inward to reach around and below the outer rim of the rivet flange 114. To install the snap-button closure part, a riveting tool pushes against the exposed topside 102 of the cap 100 and forces the capped rivet through the carrier material and against a counteracting tool that bends the free end 112 of the rivet shank outwards and upwards so that the carrier material is clamped against a clamping surface 116 at the underside of the rivet flange 114. In this process, the pressure force of the installation tool may have the effect of deforming the cap 100, thereby damaging the appearance of the capped rivet.

To solve the aforementioned problem, the capped rivet of FIG. 6 has been proposed. In addition to the rivet shank 112 and the rivet flange 114, the rivet part 110 of this capped rivet has two supporting portions 120 that are arranged between the rivet shank 112 and the cap 100 and extend approximately parallel to the inside of the cap. The supporting portions 120 are formed by cutting out and folding back two sections of the rivet flange along fold lines running between the rivet shank 112 and two windows 118 in the rivet flange that are formed as a result of this process. The supporting portions 120 form a thrust-bearing surface to counteract the effect of the insertion tool of deflecting the cap 100 towards the rivet shank 112 and thus to prevent the undesirable deformation of the cap 100.

To further stabilize the cap, a capped rivet of the kind shown in FIG. 5 is proposed in DE 196 38 450 where one of the supporting portions is folded over the other in such a manner that the topside of one supporting part is in at least partially overlapping contact with the bottom side of the other.

This arrangement provides a reliable means of preventing the undesirable deformation of the cap during the rivet-installation process. However, the known capped rivet has proven to be unsuitable for the attachment of watertight snap buttons because the windows that the supporting portions leave in the rivet flange form a leakage spot. In addition, the process of forming the supporting portions by folding back sections of the rivet flange and thereby opening up corresponding windows in the rivet flange has proven to be a problem, particularly in the case of capped rivets with flanges that have a stepped profile rather than a plane surface, e.g., in spring pin rivets. Finally, the known way of stabilizing the cap cannot be used if the diameter of the rivet flange is only insignificantly larger than the diameter of the rivet shank.

SUMMARY OF THE INVENTION

In view of the problems with the existing state of the art as explained above, the object of the present invention is to provide a capped rivet in which the deformation of the cap during the installation process is reliably prevented, in essence with no restrictions on the shape of the rivet flange.

This problem is solved through a design advancement of the known capped rivet with the essential characteristic feature that the rivet part has a reinforcing element arranged at the underside of the rivet flange, i.e., on the side that faces away from the inside of the cap.

This solution is based on the observation that the only reason for the deformation of the cap in the installation process of conventional capped rivets is that the rivet flange, which serves for attaching the cap to the rivet part, yields to the pressure force that the riveting tool exerts on the topside of the cap. In the capped rivet according to the invention, the rivet flange is strengthened by a reinforcing element. In this manner, the deflection of the rivet flange, which is the actual reason for the deformation of the cap, is reliably prevented. By arranging the reinforcing element at the underside of the rivet flange (i.e., the side that faces away from the inside of the cap), it is also assured that the reinforcing element itself will not cause an undesirable deformation of the cap due to the effect of the pressure force applied to the cap by the riveting tool. The design of the reinforcing element may be independent of the shape of the rivet flange. Overall, this solution allows an unwanted deformation of the cap to be prevented no matter what shape the rivet flange has.

In view of the tact that deformations of the rivet flange occur with particular frequency in the transition area between the rivet shank and the rivet flange and can cause appearance-degrading impressions of the upper rim of the rivet shank in the cap, it has been proven to be particularly practical if the reinforcing element is arranged in the area where the inner border of the rivet flange meets the rivet shank. With this arrangement, the occurrence of unwanted deformations can reliably be prevented even in capped rivets of the smallest rivet flange diameters because the reinforcing element can be formed independently of the rivet flange with a diameter corresponding to or smaller than the rivet flange diameter.

An arrangement where the reinforcing element backs immediately against the underside of the rivet flange is particularly reliable in preventing unwanted deformations. In this, it has proven to be especially practical if the reinforcing element is shaped like a ring that coaxially surrounds the rivet shank.

A capped rivet in accordance with the invention is particularly simple to produce if the reinforcing element is formed in one piece together with the rivet shank. This can be achieved by giving the reinforcing element the form of a protuberance of the rivet shank. In the last described embodiment of the invention, a particularly strong support of the rivet flange is assured if the protuberance has the shape of a reinforcing convex bead that is concentric to the axis of the rivet shank and has a first flank lying flat against the underside of the rivet flange and a second flank lying flat against the side of the first flank that faces away from the underside of the rivet flange. This arrangement provides between the cap and the rivet shank a supporting portion for the cap that is three times the material thickness of the rivet part, which is reliable in preventing the upper rim of the rivet shank from impressing its shape into the cap during the riveting process. In this manner, the reinforcing bead can be formed on the rivet part even with rivet flanges of the smallest diameters without the need for adding more stamping material to the rivet part. Furthermore, this particularly strong supportive backing of the cap allows unwanted deformations to be reliably prevented even when caps of a relatively thin material are used.

In the following, the invention is explained on the basis of the drawing, which is hereby explicitly introduced as reference for the disclosure of all features that are essential to the invention but are not detailed in the text.

DETAILED DESCRIPTION OF THE INVENTION

Figure 1A:
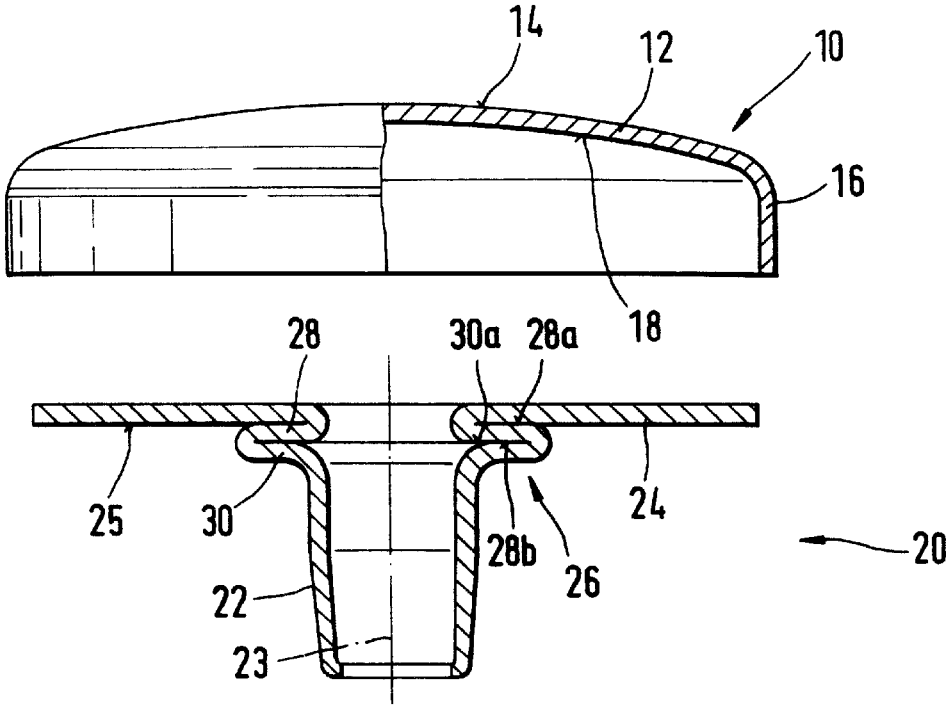
FIG. 1*a* represents the individual components of a capped rivet.

The cap shown in FIG. 1*a* comprises a dome-shaped central portion 12 with an exposed topside 14 and an outer rim 16 that is bent downward from the central portion 12 and has the approximate shape of a circular cylinder wall. In the embodiment of the invention according to FIG. 1, the rivet part 20 that is in addition required for producing the inventive capped rivet consists in essence of a rivet shank 22, a plane rivet flange 24, and a reinforcing element 26 arranged between the rivet shank 22 and the rivet flange 24. The reinforcing element 26 is formed integrally out of the same piece with the rivet shank 22 and the rivet flange 24 in the shape of a protruding ridge on the rivet shank 22 that extends in a circle around the rivet shank axis 23 and is produced as a press-formed reinforcing bead. The reinforcing bead has a first flank 28 that is folded radially outwards from the inner border of the rivet flange 24 and a second flank 30 that is folded radially inwards from the first flank 28 and then continues into the rivet shank 22 that is approximately shaped like a circular cylinder. The upside 28*a* of the first flank 28 lies flat against the underside 25 of the rivet flange 24 (which faces away from the cap 10), and the upside 30*a* of the second flank lies flat against the downside 28*b* of the first flank. The result of this arrangement is a supportive backing area for the cap 10, which has three times the material thickness of the rivet part 20 in the area where the inner border of the rivet flange 24 meets the rivet shank 22.

Figure 1B:
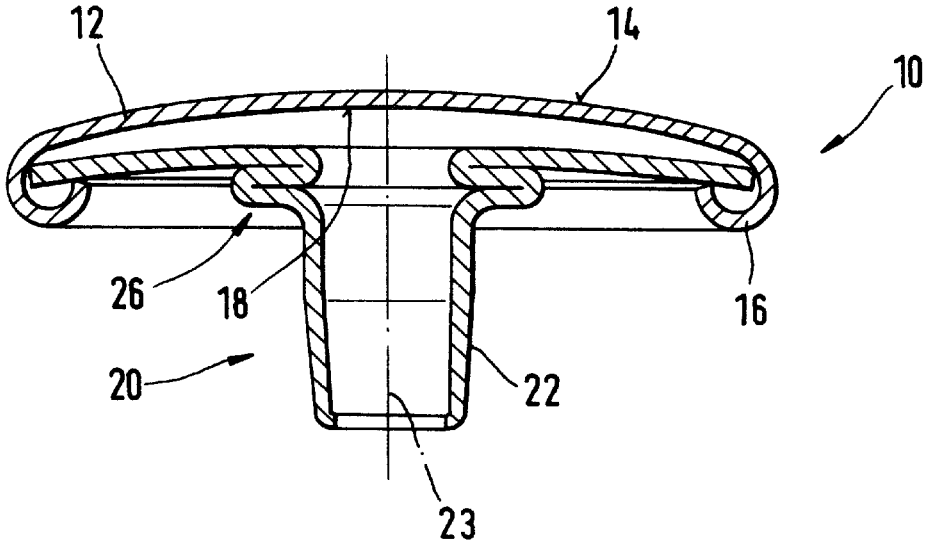
FIG. 1*b* represents a capped rivet made in accordance with a first embodiment of the invention.

To manufacture a capped rivet according to the invention, the cap 10 is set on the rivet flange 24 of the rivet part 20, and the outer rim 16 of the cap 10 is folded inwards and then upwards, so that the outer rim of the rivet flange 24 is engaged from below by the outer rim 16 of the cap 10, as illustrated in FIG. 1*b*.

Figure 2A:
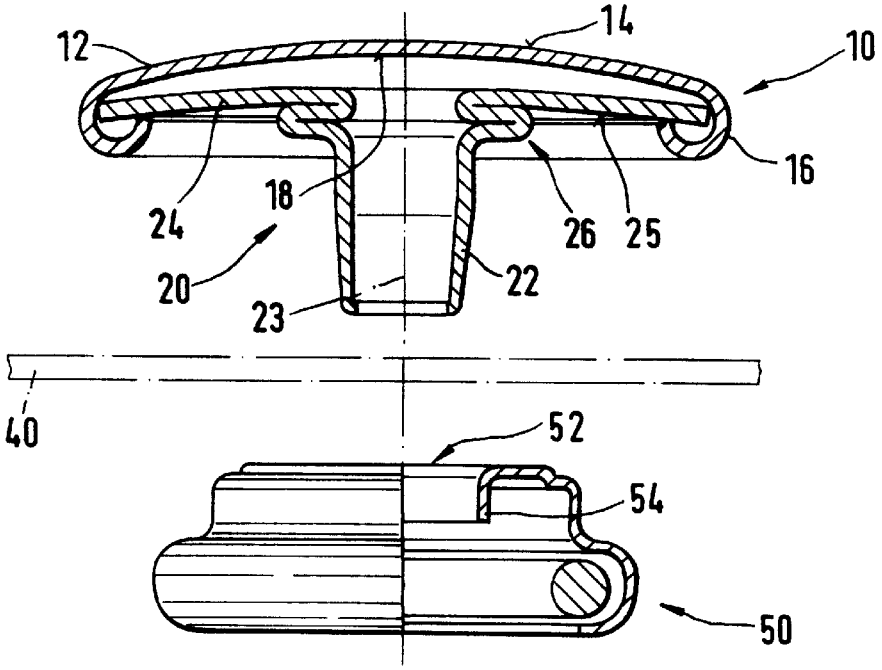
FIGS. 2*a* and 2*b* illustrate the installation process of a snap-button closure part using the capped rivet of FIG. 1.
Figure 2B:
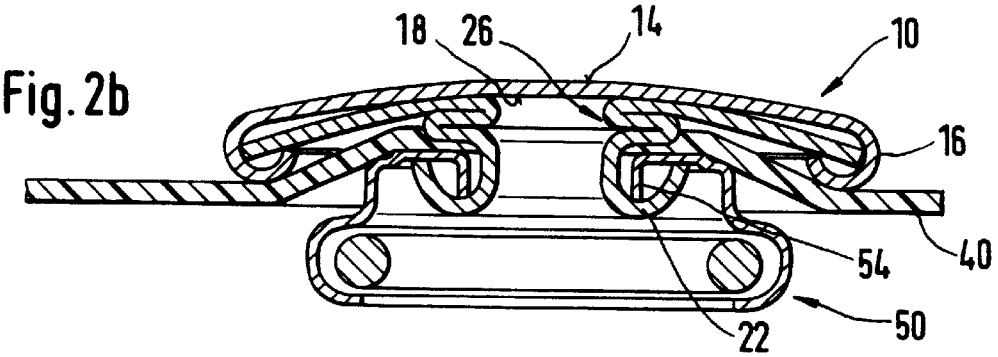

As visualized in FIG. 2, a capped rivet according to FIG. 1 can be used, e.g., for attaching a snap-button closure part in the form of a snap eyelet 50 to a sheet-like carrier material 40. This is accomplished by first positioning the capped rivet on one side of the carrier material 40 and the snap eyelet 50 on the other side. Next, by means of a riveting tool pressing against the topside 14 of the cap 10, the rivet shank 22 of the rivet part 20 is pushed through the carrier material 40 and inserted into a central opening 52 of the snap eyelet 50 that is bordered by a rim 54 shaped approximately like a circular cylinder wall running parallel to the axis 23 of the rivet shank. As a last step, the rivet shank 22 is folded outwards and upwards by means of the riveting tool and a counteracting tool holding the eyelet 50, so that the rivet shank reaches around the rim 54 of the central opening 52 as illustrated in FIG. 2*b*.

During the installation process, the inside 18 of the cap 10 is pushed against the rivet flange 24 due to the pressure force of the riveting tool against the topside 14 of the cap 10. However, the reinforcing element 26 prevents the deformation of the rivet flange 24, which alone would otherwise cause an unwanted deformation of the cap. The reinforcing element 26 particularly prevents the rivet flange 24 from being bent downward in the area where the rivet shank 22 meets the rivet flange 24, which would cause an impression of the upper rim of the rivet shank to be stamped into the cap 10.

Figure 3:
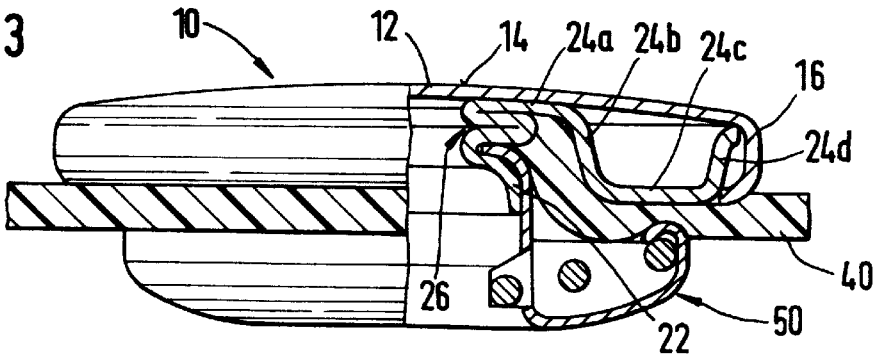
FIG. 3 represents an attachable element according to a second embodiment of the invention installed on a carrier material.

As illustrated in FIG. 3, a capped rivet according to the invention can also be used to attach a spring pin cap in which the flange is not normally flat but has a shape which from the upper rim of the rivet shank starts out through an inner zone 24*a* running approximately parallel to the cap 10, then curves downward and continues through a transitional segment 24*b* followed by an intermediate segment 24*c* that is again approximately parallel to the cap 10, and terminates in an upward-bent outer rim 24 of the rivet flange.

Figure 4:
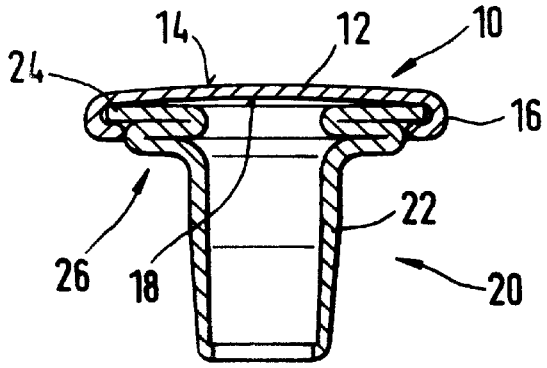
FIG. 4 represents a cross-sectional view of the capped rivet in accordance with a third embodiment of the invention.
Figure 5:
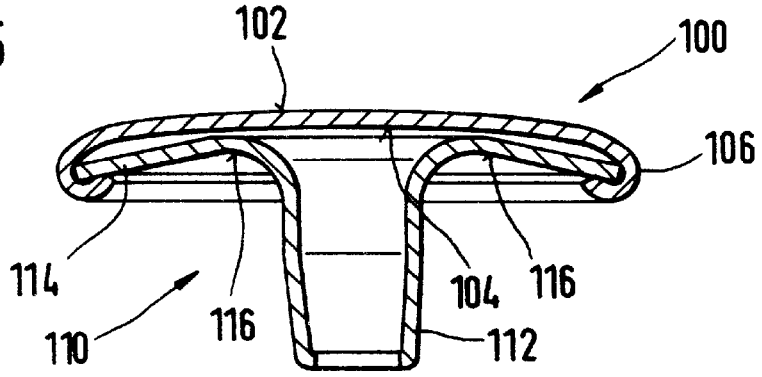
FIG. 5 represents a cross-sectional view of a capped rivet according to the existing state of the art.
Figure 6:
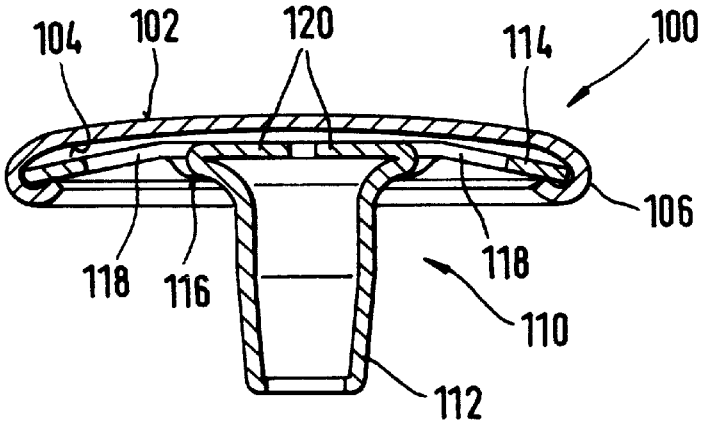
FIG. 6 represents a cross-sectional view of another capped rivet according to the existing state of the art.

As can further be seen in FIG. 4, the inventive improvement of the known capped rivet can also be realized in a case where the diameter of the rivet flange 24 is only insignificantly larger in comparison to the diameter of the rivet shank 22.

The invention is not limited to the embodiments discussed above with reference to the drawing. Rather, the scope of possible design concepts also includes using the inventive capped rivets to attach ball-shaped, snap-button elements or using the capped rivets ornamental elements. Furthermore, the rivet flange of the inventive capped rivet may also have a differently shaped profile.

What is claimed is:

1. A capped rivet comprising a cap with an exposed topside and an inside, and a rivet part with a rivet shank and a rivet flange, the rivet shank extending away from the inside of the cap and the rivet flange extending transverse to the axis of the rivet shank, the rivet flange being firmly attached to the cap and having an underside facing away from the inside of the cap, further comprising a reinforcing element at the underside of the rivet flange, wherein the reinforcing element is ring-shaped and coaxially surrounds the rivet shank.

2. The capped rivet according to claim 1, wherein the rivet flange has an inner border area where the rivet flange meets the rivet shank and the reinforcing element is arranged at the inner border area.

3. The capped rivet according to claim 1, wherein the reinforcing element is lying flat against the underside of the rivet flange.

4. The capped rivet according to claim 1, wherein the cap is essentially dome-shaped.

5. The capped rivet according to claim 1, wherein the capped rivet is part of an attachable element and has a counterpart that can be slid onto the rivet shank and fastened to the capped rivet by deforming the rivet shank.

6. The capped rivet according to claim 5, wherein the attachable element is attached to a carrier material by clamping the carrier material between the rivet flange and the counterpart.

7. A capped rivet comprising a cap with an exposed topside and an inside, and a rivet part with a rivet shank and a rivet flange, the rivet shank extending away from the inside of the cap and the rivet flange extending transverse to the axis of the rivet shank, the rivet flange being firmly attached to the cap and having an underside facing away from the inside of the cap, further comprising a reinforcing element at the underside of the rivet flange, wherein the reinforcing element is formed of one piece with the rivet shank, wherein the reinforcing element is formed as a protuberance of the rivet shank, wherein the protuberance is formed as a reinforcing bead coaxially surrounding the rivet shank, the reinforcing bead having a first flank and a second flank, each of the flanks with an upside facing towards the underside of the rivet flange and a downside facing the other way, and wherein the upside of the first flank is lying flat against the underside of the rivet flange and the upside of the second flank is lying flat against the downside of the first flank.

8. The capped rivet according to claim 7, wherein the capped rivet is part of an attachable element and has a counterpart that can be slid onto the rivet shank and fastened to the capped rivet by deforming the rivet shank.

9. The capped rivet according to claim 7, wherein the attachable element is attached to a carrier material by clamping the carrier material between the rivet flange and the counterpart.

* * * * *